US007568684B2

(12) United States Patent
Doucet

(10) Patent No.: US 7,568,684 B2
(45) Date of Patent: Aug. 4, 2009

(54) SIGNATURE TRANSPORT DEVICE WITH INHIBIT FEATURE

(75) Inventor: Louis J. Doucet, Salem, NH (US)

(73) Assignee: Goss International Americas, Inc., Durham, NH (US)

( * ) Notice: Subject to any disclaimer, the term of this patent is extended or adjusted under 35 U.S.C. 154(b) by 296 days.

(21) Appl. No.: 11/280,706

(22) Filed: Nov. 16, 2005

(65) Prior Publication Data

US 2007/0108687 A1 May 17, 2007

(51) Int. Cl.
*B65H 37/04* (2006.01)

(52) U.S. Cl. ..... 270/52.04; 270/52.14; 270/52.16; 270/52.26; 270/52.29; 270/58.29

(58) Field of Classification Search ..... 270/52.04, 270/52.14, 52.16, 52.26, 52.29, 58.29
See application file for complete search history.

(56) References Cited

U.S. PATENT DOCUMENTS

| | | | | |
|---|---|---|---|---|
| 4,170,288 | A * | 10/1979 | Mebus | 198/440 |
| 4,260,145 | A | 4/1981 | Mebus et al. | 270/54 |
| 4,482,141 | A | 11/1984 | Moser | 270/54 |
| 5,435,534 | A * | 7/1995 | Linkowski et al. | 270/51 |
| 6,082,724 | A | 7/2000 | Kahlig et al. | |
| 6,612,559 | B2 * | 9/2003 | Boss | 270/52.18 |
| 6,789,793 | B2 * | 9/2004 | Caunter et al. | 271/175 |
| 6,866,257 | B2 | 3/2005 | Bruenner et al. | 270/52.26 |
| 2003/0214092 | A1 * | 11/2003 | Horii et al. | 270/52.18 |
| 2005/0225023 | A1 | 10/2005 | Schlough | 271/69 |

* cited by examiner

*Primary Examiner*—Gene Crawford
*Assistant Examiner*—Leslie A Nicholson, III
(74) *Attorney, Agent, or Firm*—Davidson, Davidson & Kappel, LLC

(57) ABSTRACT

A signature transport device includes a first conveyor moving a first signature and a second signature in a first direction. A signature lifting device removes the first signature from the first conveyor and a gripper removes the first signature from the signature lifting device at a first location. The signature lifting device has an inhibit position where the second signature follows a path, the path bypassing the first location so that the gripper bypasses the second signature. The present invention also provides for a method for transporting signatures.

8 Claims, 3 Drawing Sheets

SIGNATURE TRANSPORT DEVICE WITH INHIBIT FEATURE

BACKGROUND

The present invention relates to a device for transporting printed products.

A saddle stitcher, for example, may collate signatures to assemble complete sets of signatures and bind them together using stitches. The signatures are opened to the center fold and collated by feeding mechanisms onto a saddle raceway to be conveyed past a stitching mechanism. These bound signatures, or books, are then removed from the saddle conveyor for further processing, such as trimming the unbound edges.

U.S. Patent Application No. 2005/0225023, hereby incorporated by reference herein, discloses a device for transporting printed products that permits removal of signatures from a saddle conveyor. A first conveyor moves a plurality of folded signatures in a first direction and a second conveyor includes a rotating blade device for lifting a signature from the first conveyor.

U.S. Pat. No. 4,482,141 discloses a method and device for conveying signatures from a blade chain conveyor supporting the signatures directly at a fold line. The signatures are gripped from above by orbitally-rotating clamping pads, which then transfer the signatures to a belt conveyor perpendicular to the blade chain conveyor.

U.S. Pat. No. 4,260,145 discloses a tucker blade mechanism which contacts the folded edge of the signature from below the saddle conveyor. The tucker blade mechanism moves the signature forwardly and upwardly from the saddle conveyor as it moves in a vertical plane through a path which is oblique relative to the saddle conveyor.

BRIEF SUMMARY OF THE INVENTION

An object of the present invention is to prevent removal of incomplete signatures from a saddle conveyor thereby preventing further transport of incomplete signatures. An alternate or additional object is to split a signature stream.

The present invention provides a signature transport device comprising:

- a first conveyor moving a first and a second signature in a first direction,
- a signature lifting device for removing the first signature from the first conveyor; and
- a gripper for removing the first signature from the signature lifting device at a first location, the signature lifting device having an inhibit position where the second signature follows a path, the path bypassing the first location.

The signature transport device may include a signature lifting device with a first group of blades for lifting the first signature and a second group of blades for lifting the second signature. The signature lifting device may include a cam, with one section of the cam being movable. Each blade may have a cam follower. The cam followers may follow along the top or underside surface of the cam.

The present invention also provides a method for transporting signatures comprising the steps of:

- moving a first signature and a second signature in a first direction;
- lifting the first signature, to define a raised position;
- gripping the first signature at the raised position; and
- moving the second signature to bypass the raised position.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Figure 1:
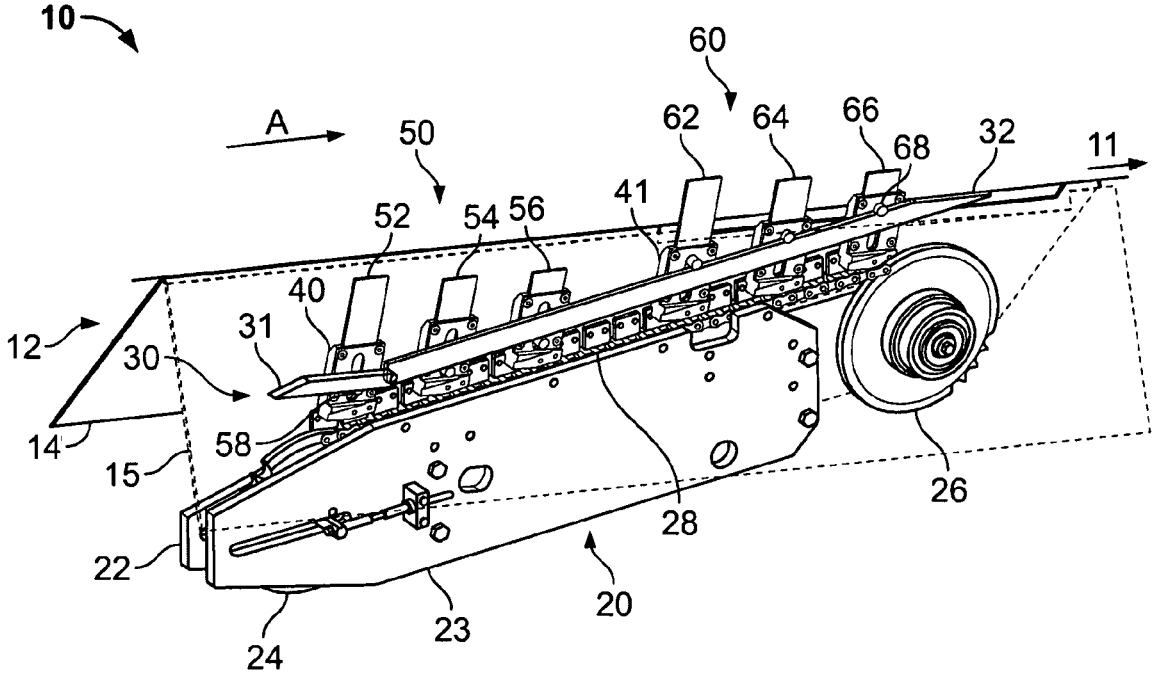
FIG. 1 shows a perspective view of an embodiment of a signature transport device according to the present invention with the nearmost portion of a raceway transparent to reveal the signature lifting device.

FIG. 1 shows a preferred exemplary embodiment of a saddle stitcher having a signature transport device 10. U.S. Pat. No. 6,866,257 for example discloses a saddle stitcher and is hereby incorporated by reference herein.

Signature transport device 10 includes a conveyor 11 for stitched products, a signature lifting device 20 and a raceway 12. Raceway 12 has two sides 14, 15. Signature lifting device 20 includes base walls 22, 23, sprockets 24, 26, a chain 28 (partially shown) and a cam 30. Cam 30 includes a movable cam 31 and fixed cam 32. Sprocket 24 passes between base walls 22, 23. Chain 28 supports a number of blades including a first group of blades 60 and a second group of blades 50. Further tucker blade groups may be attached to chain 28.

Tucker blade group 60 may include multiple tucker blade supports 41, tucker blades 62, 64, 66 and cam followers 68. Each tucker blade support 41 holds one tucker blade 62, 64, 66. A cam follower 68 extends out from each tucker blade 62, 64, 66.

Tucker blade group 50 may include multiple tucker blade supports 40, tucker blades 52, 54, 56 and cam followers 58. Each tucker blade support 40 holds one tucker blade 52, 54, 56. A cam follower 58 extends out from each tucker blade 52, 54, 56.

Chain 28 moves tucker blade groups 50, 60 around signature lifting device 20 in direction A. Cam followers 58, 68 contact movable cam 31 and fixed cam 32. Cam followers 68 slide along a top surface 35 of movable cam 31 and a top surface 36 of cam 32 (see FIG. 5) demonstrated by tucker blade group 60. Alternatively, cam followers 58 slide along an underside surface 37 of movable cam 31 and an underside surface 38 of cam 32 (see FIG. 6) demonstrated by tucker blade group 50. Tucker blades 62, 64, 66 extend up through the top of raceway 12 in between sides 14, 15 as tucker blade group 60 travels on chain 28 in direction A from sprocket 24 to sprocket 26. Retracted tucker blades 52, 54, 56 do not extend as much as extended tucker blades 62, 64, 66, and thus follow a lower retracted path.

Figure 2:
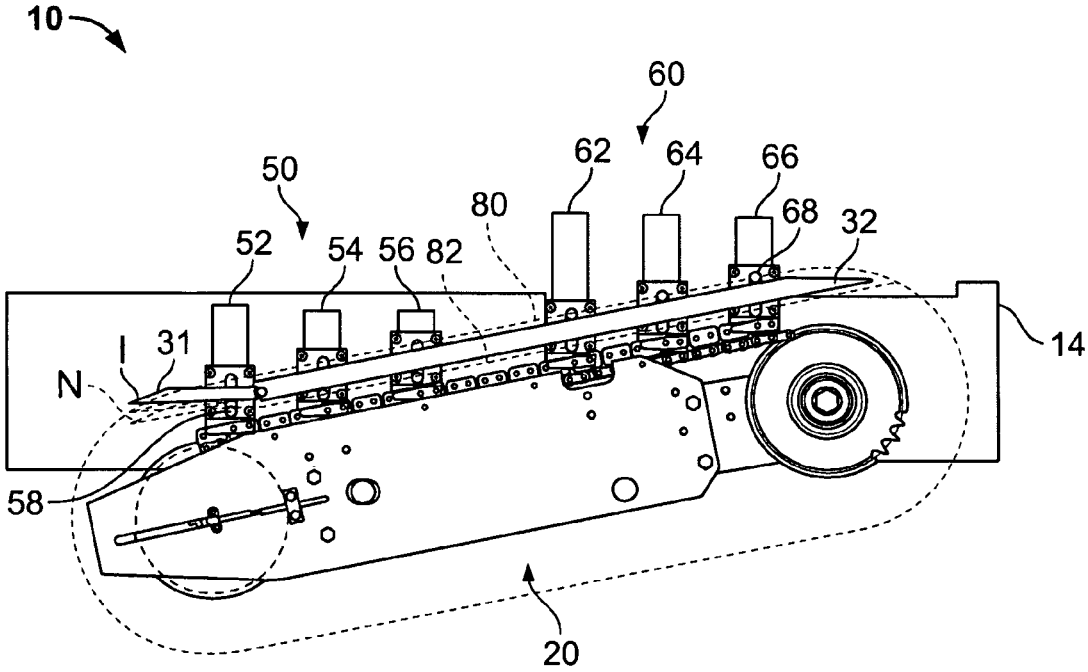
FIG. 2 shows a side view of the raceway with one raceway guide removed to reveal the signature transport device.

FIG. 2 shows a side view of signature transport device 10 with one side 15 removed to reveal signature lifting device 20. Movable cam 31 has two main positions, a normal position N and an inhibit position I. Cam followers 68 circulate around signature transport device 20 along a normal path 80 when movable cam 31 is in normal position N. For example, tucker blade group 60, is in the normal position. Cam followers 58 circulate around signature transport device 20 along an inhibit path 82 when movable cam 31 is in inhibit position I. For example tucker blade group 50 is in the inhibit position. Another device, for example, a pneumatic cylinder, sets movable cam 31 in normal position N or inhibit position I. In an alternative embodiment, movable cam 31 may move along a path perpendicular to top surface 36 of cam 32 to position movable cam 31 into and out of normal path 80.

Figure 3:
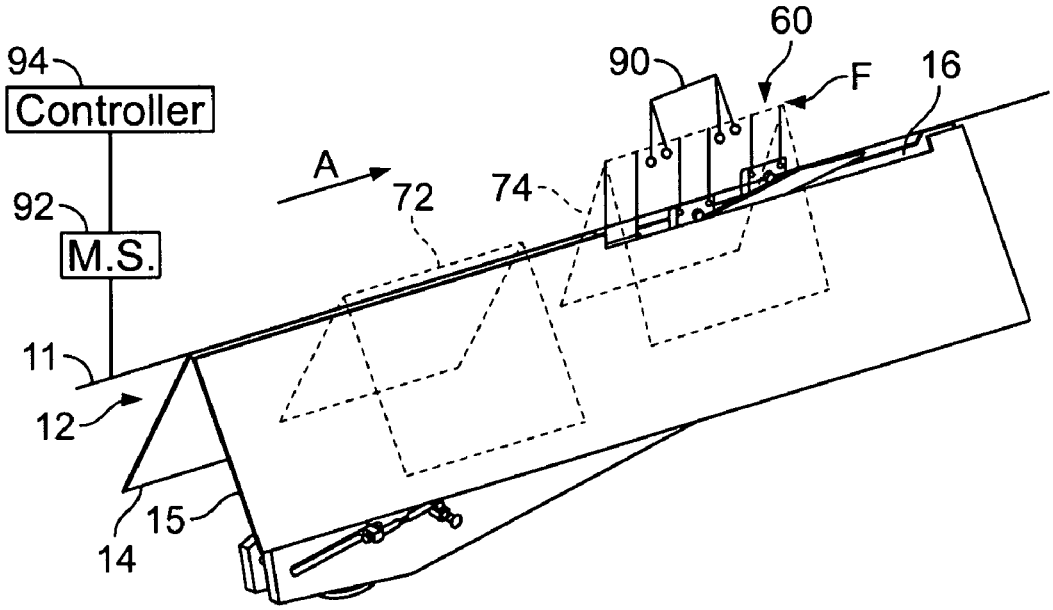
FIG. 3 shows two transparent signatures traveling in direction A along the raceway.

FIG. 3 shows an incomplete or otherwise faulty signature 72 and a complete signature 74 traveling in direction A along raceway 12. Raceway 12 further includes a gap 16. Gap 16 is the space between the top of sides 14, 15. Conveyor 11 brings signatures 72, 74 to the signature transport device 10. A misfeed sensor 92, for example at a hopper, relays information to a controller 94, which can set the movable cam 31 position and knows the location of the signatures 72, 74. U.S. Pat. No. 6,082,724, hereby incorporated by reference herein, for example shows a misfeed sensor.

When signature 74 is recognized as complete, blades encounter movable cam 31 in position N. The blades, for example, extended tucker blade group 60, travel along normal path 80 along the top surfaces 35,36 of movable cam 30 and cam 32 (see FIG. 5.) Tucker blades 62, 64, 66 extend up through gap 16 and contact complete signature 74 along a fold F. Complete signature 74 rises off raceway 12 and is moved along for further transport. Grippers 90 may then take control of complete signature 74, and may be similar to grippers shown in U.S. Patent Application No. 2005/0225023.

If an incomplete signature 72 is detected, for example by misfeed sensor 92, controller 94 may move cam 30 from position N to position I. The blades, for example blade group 50, travel along inhibit path 82 along the underside surfaces 37, 38 of movable cam 31 and cam 32 (see FIGS. 2 and 6). Cam followers 58 lower into the cam supports 40 and tucker blades 52, 54, 56 retract. Retracted tucker blades 52, 54, 56 do not extend through gap 16 as much as tucker blade group 60. Incomplete signature 72 is not lifted as high off raceway 12 as complete signature 74. In an alternative embodiment, the retracted blades 52, 54, 56 do not contact signature 72 at all. Thus, grippers 90 are not able to grip incomplete signature 72 preventing further transport by grippers 90. Incomplete signature 72 thus can be transported further by conveyor 11 for discarding or repair.

Figure 4:
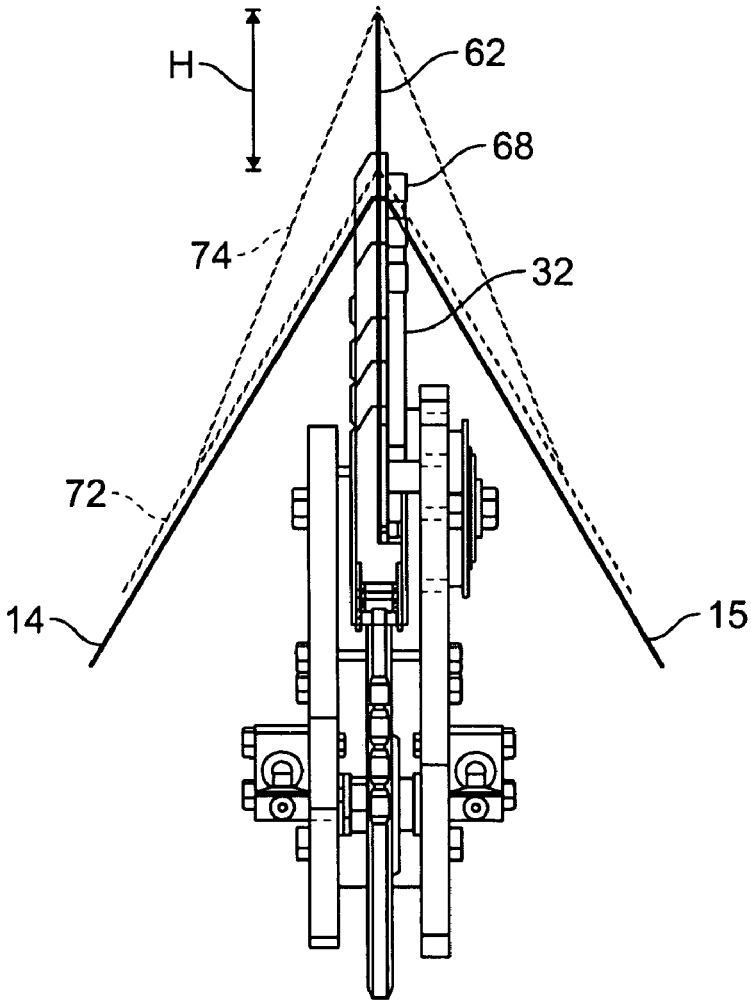
FIG. 4 shows a front entry view of signatures on the raceway.

FIG. 4 shows a front entry view of signatures 72, 74 on raceway 12. Cam follower 68 pushes tucker blade 62 up. As tucker blade 62 rises, complete signature 74 lifts off raceway 12. Incomplete signature 72 remains on raceway 12. A height differential H represents the distance between lifted complete signature 74 and incomplete signature 72.

Figure 5:
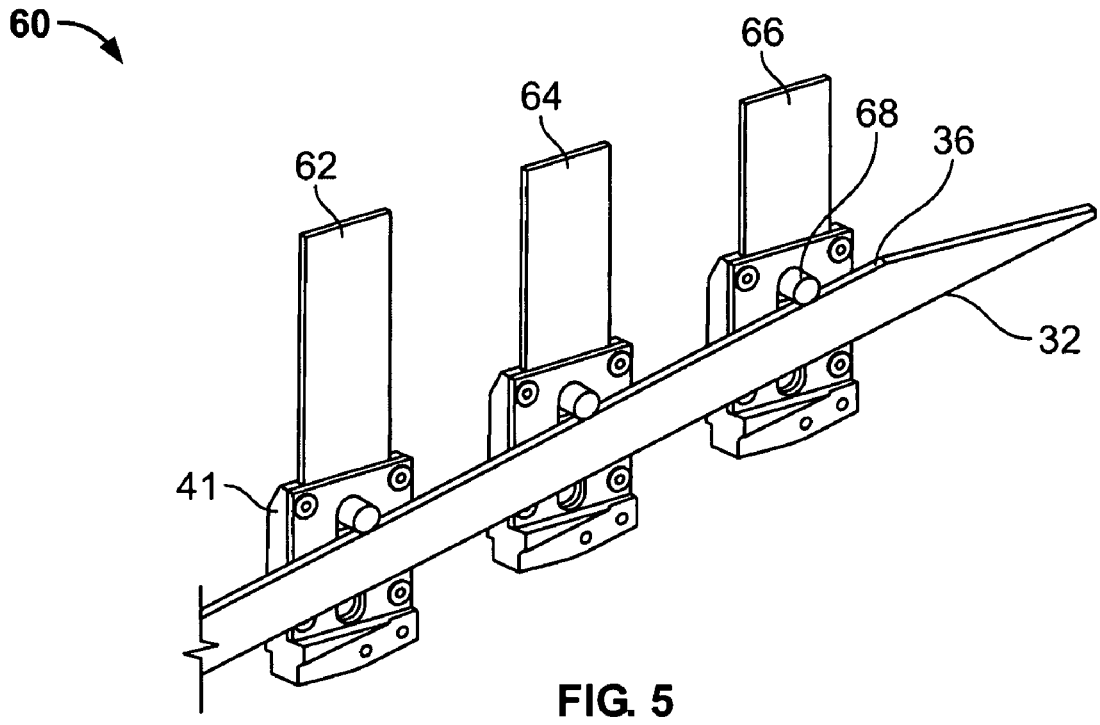
FIG. 5 shows an enlarged perspective view of the extended tucker blade assembly.

FIG. 5 shows a detail of one embodiment of extended blade group 60. Cam 30 is in normal position N when tucker blade group 60 approaches. Cam followers 68 move along a top cam surface 36 of cam 32 following normal path 80. Cam followers 68 rise and raise tucker blades 62, 64, 66 which extend up through gap 16 in between walls 14. Tucker blade supports 41 may have springs to support extended tucker blades 62, 64, 66.

An alternate configuration could have tucker blades 62, 64, 66 normally retracted as tucker blade group 60 travels around normal path 80. In this arrangement, cam 30 would be designed to extend the tucker blades 52, 54, 56 rather then retract them when the tucker blade group 50 travels around inhibit path 82.

Figure 6:
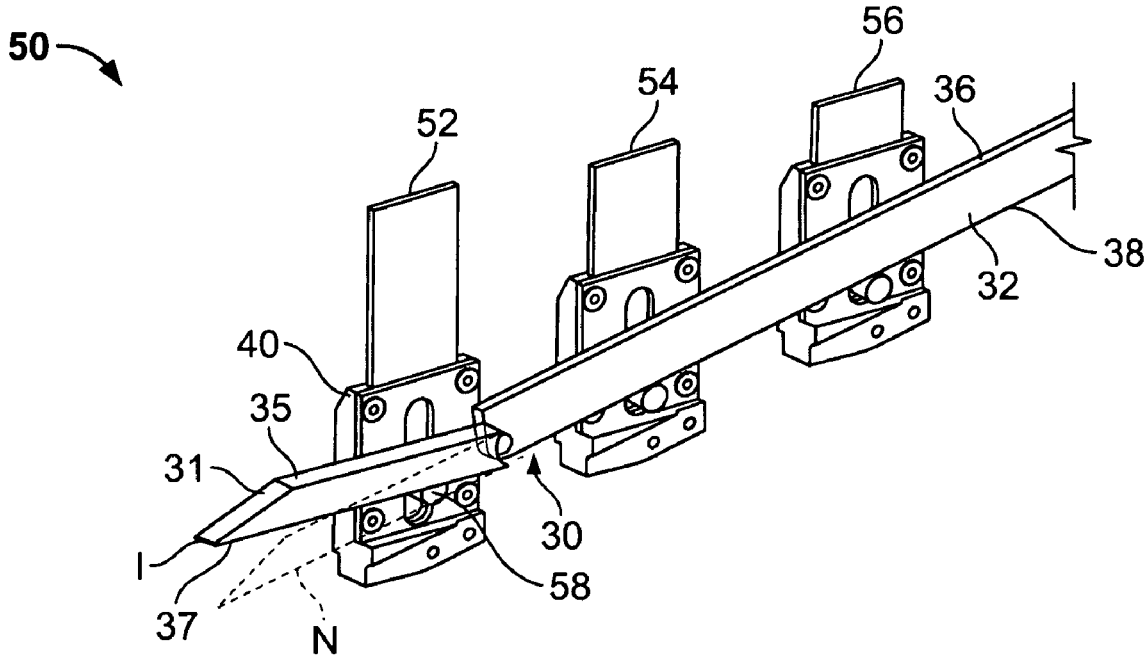
FIG. 6 shows an enlarged perspective view of the retracted tucker blade assembly.

FIG. 6 shows a detail of one embodiment of retracted blade group 50. Tucker blade group 50 approaches cam 30 in inhibit position I. Cam followers 58 move along underside surface 37 of movable cam 31 following inhibit path 82. Cam 30 pushes cam followers 58 down causing respective tucker blades 52, 54, 56 to lower and retract into tucker blade supports 40. Tucker blades 52, 54, 56 remain retracted and do not extend through gap 16. Incomplete signature 72 does not rise as much as complete signature 74.

The term "signature", as defined herein, can include a single sheet or multi-sheet printed product, which may also be referred to as a book, and may be stitched or unstitched. Instead of being used as a complete or damaged signature removal device, cam 30 could be pivoted by controller 94 at regular intervals to provide a signature stream splitting device, with one stream following the grippers 90 and one the conveyor 11.

What is claimed is:

1. A signature transport device comprising:

a first saddle conveyor moving a first signature and a second signature in a first direction;

a signature lifting device for removing the first signature from the first saddle conveyor; and a gripper for removing the first signature from the signature lifting device at a first location by contacting a fold of the first signature, the signature lifting device having an inhibit position where the second signature follows a path, the path bypassing the first location;

the signature lifting device including a first blade extending into a fold of the first signature and lifting the first signature and a second blade extending into a fold of the second signature and lifting the second signature, wherein the first blade has a cam follower, the cam follower following along a first cam surface.

2. The signature transport device as recited in claim 1 wherein the second blade has a second cam follower following along a second cam surface opposite to the first cam surface.

3. The signature transport device as recited in claim 2 wherein the second cam surface defines the inhibit position.

4. A signature transport device comprising:

a first saddle conveyor moving a first signature and a second signature in a first direction;

a signature lifting device for removing the first signature from the first saddle conveyor; and a gripper for removing the first signature from the signature lifting device at a first location by contacting a fold of the first signature, the signature lifting device having an inhibit position where the second signature follows a path, the path bypassing the first location;

the signature lifting device including a first blade extending into a fold of the first signature and lifting the first signature and a second blade extending into a fold of the second signature and lifting the second signature, wherein the signature lifting device includes a cam, the cam including a moveable cam section.

5. The signature transport device as recited in claim 4 wherein the moveable cam moves to define the inhibit position.

6. The signature transport device as recited in claim 4 wherein the cam includes an underside surface which defines the inhibit position.

7. A signature transport device comprising:

a first saddle conveyor moving a first signature and a second signature in a first direction;

a signature lifting device for removing the first signature from the first saddle conveyor;

a gripper for removing the first signature from the signature lifting device at a first location by contacting a fold of the first signature, the signature lifting device having an inhibit position where the second signature follows a path, the path bypassing the first location;

the signature lifting device including a first blade extending into a fold of the first signature and lifting the first signature and a second blade extending into a fold of the second signature and lifting the second signature; and a controller and sensor for sensing an improper signature, the controller setting the signature lifting device in the inhibit position when an improper signature is sensed.

8. A signature transport device comprising:

a first saddle conveyor moving a first signature and a second signature in a first direction;

a signature lifting device for removing the first signature from the first saddle conveyor; and a gripper for removing the first signature from the signature lifting device at a first location by contacting a fold of the first signature, the signature lifting device having an inhibit position where the second signature follows a path, the path bypassing the first location;

the signature lifting device including a plurality of blades for extending into a fold of the first signature and lifting the first signature, the blades having different heights.

* * * * *